US010399831B2

(12) United States Patent
Moll et al.

(10) Patent No.: US 10,399,831 B2
(45) Date of Patent: Sep. 3, 2019

(54) LIFTING DEVICE, IN PARTICULAR A CABLE WINCH

(71) Applicant: Konecranes Global Corporation, Hyvinkää (FI)

(72) Inventors: Oliver Moll, Solingen (DE); Ahmet Uzun, Wetter (DE)

(73) Assignee: Konecranes Global Corporation, Hyvinkää (FI)

( * ) Notice: Subject to any disclaimer, the term of this patent is extended or adjusted under 35 U.S.C. 154(b) by 0 days.

(21) Appl. No.: 15/574,708

(22) PCT Filed: May 25, 2016

(86) PCT No.: PCT/EP2016/061819
§ 371 (c)(1),
(2) Date: Nov. 16, 2017

(87) PCT Pub. No.: WO2016/189043
PCT Pub. Date: Dec. 1, 2016

(65) Prior Publication Data

US 2018/0148305 A1 May 31, 2018

(30) Foreign Application Priority Data

May 26, 2015 (DE) ..... 10 2015 108 265

(51) Int. Cl.
*B66D 1/28* (2006.01)

(52) U.S. Cl.
CPC ..... *B66D 1/28* (2013.01); *B66D 2700/0183* (2013.01)

(58) Field of Classification Search
CPC ..... B66D 1/28; B66D 2700/0183
See application file for complete search history.

(56) References Cited

U.S. PATENT DOCUMENTS 1,436,375 A 11/1922 Barney
4,736,929 A * 4/1988 McMorris ..... B66D 1/22 254/323

(Continued)

FOREIGN PATENT DOCUMENTS

DE 842705 C 6/1952
DE 4310770 A1 10/1994

(Continued)

OTHER PUBLICATIONS

Preliminary Report on Patentability of the International Searching Authority in English from corresponding Patent Cooperation Treaty (PCT) Application No. PCT/EP2016/061819, completed Aug. 25, 2017.

(Continued)

*Primary Examiner* — Emmanuel M Marcelo
(74) *Attorney, Agent, or Firm* — Gardner, Linn, Burkhart & Ondersma LLP

(57) ABSTRACT

A cable winch having a base frame with at least two base plates, and at least two longitudinal beams for connecting the base plates to each other. One of the base plates is designed such that the longitudinal beams can be installed or removed in the direction of the longitudinal axis of the longitudinal beams through the base plate, with passage openings in the base plate for feeding the longitudinal beams there through, and with one beam end of each of the longitudinal beams inserted into one of the passage openings. A beam end of each of the longitudinal beams is fastened to the base plate in and against the direction of the longitudinal axis of the longitudinal beam by a retaining element that is fastened to an outer face of the base plate, wherein a separate retaining element is provided for each longitudinal beam in order to enable simple assembly, disassembly, or conversion.

20 Claims, 4 Drawing Sheets

(56) References Cited

U.S. PATENT DOCUMENTS

| | | | | |
|---|---|---|---|---|
| 6,494,437 | B1 | 12/2002 | Boyer | |
| 2007/0029533 | A1* | 2/2007 | Winter | B66D 1/28 254/266 |
| 2008/0061277 | A1 | 3/2008 | Grapes et al. | |
| 2009/0308826 | A1* | 12/2009 | Kempf | B66C 9/02 212/270 |
| 2010/0288906 | A1* | 11/2010 | Piech | B66B 11/0438 248/636 |
| 2011/0079760 | A1 | 4/2011 | Kempf | |
| 2012/0267592 | A1* | 10/2012 | Zhao | B66D 1/28 254/266 |
| 2012/0280190 | A1* | 11/2012 | Zhao | B66C 11/00 254/266 |
| 2014/0341696 | A1 | 11/2014 | Simula et al. | |
| 2016/0068376 | A1* | 3/2016 | Fretz | B66D 3/00 254/219 |
| 2018/0194600 | A1* | 7/2018 | Schulte | B66D 1/28 |

FOREIGN PATENT DOCUMENTS

| | | | |
|---|---|---|---|
| DE | 19602927 | A1 | 7/1997 |
| DE | 102005029113 | B3 | 8/2006 |
| DE | 102010026651 | A1 | 1/2012 |
| EP | 2641861 | A1 | 9/2013 |
| EP | 2501640 | B1 | 10/2013 |
| FR | 2928637 | A1 | 9/2009 |
| JP | 2000063088 | A | 2/2000 |
| WO | 2011061150 | A1 | 5/2011 |

OTHER PUBLICATIONS

International Search Report and Written Opinion of the International Searching Authority from corresponding Patent Cooperation Treaty (PCT) Application No. PCT/EP2016/061819, indicated completed on Aug. 26, 2016.

International Preliminary Examination Report from corresponding Patent Cooperation Treaty (PCT) Application No. PCT/EP2016/061819, dated Apr. 28, 2017.

* cited by examiner

LIFTING DEVICE, IN PARTICULAR A CABLE WINCH

CROSS REFERENCE TO RELATED APPLICATIONS

The present application claims the priority benefits of International Patent Application No. PCT/EP2016/061819, filed May 25, 2016, and claims benefit of German Application DE102015108265.9, filed on May 26, 2015, which are incorporated herein by reference.

BACKGROUND OF THE INVENTION

The invention relates to a lifting device, in particular a cable winch, having a base frame comprising at least two base plates, having at least two longitudinal supports comprising a first support end and an opposing second support end, said longitudinal supports connecting the base plates together and spacing them apart, wherein the first support end and the second support end of the longitudinal supports are detachably fastened to the base plates of the lifting device in such a way and one of the at least two base plates is designed in such a way that the longitudinal supports can be installed or removed in the direction of the longitudinal axis thereof and through one of the at least two base plates, for which purpose passage openings for passage of the longitudinal supports are provided in one of the base plates of the at least two base plates, in each case one support end of the longitudinal supports is inserted and fastened in one of the passage openings and the support end of the longitudinal supports is fixed to the base plate in and opposite to the direction of the longitudinal axis of the longitudinal support by means of a retaining element, for which purpose the retaining element is fastened to an outer side of the base plate.

A motorised cable winch for lifting work in the theatre is known from the German patent application DE 43 10 770 A1. This motorised cable winch is driven by an electric driving motor which acts on a cable drum via a transmission. The transmission is disposed together with two brakes within the cable drum. The cable drum is mounted at both ends in a base frame consisting of two mutually spaced apart base plates which are oriented in parallel with one another. The base plates each have a rectangular shape and are fastened to one another via four longitudinal supports oriented in parallel with the longitudinal axis of the cable drum. The longitudinal supports are designed as spacing pipes which are each connected to the base plates in the corner regions thereof by means of a tension rod guided within the spacing pipe and threaded nuts screwed onto the ends thereof. In this connection, the planar end surfaces of the spacing pipes lie against the inner sides of the base plates in the region of through-bores for the tension rods.

Furthermore, in the introductory part of the description of German patent application DE 196 02 927 A1, lifting devices, in particular electric cable winches, are described which are modularly constructed from the electric, motor, transmission, cable drum, supporting means and base frame assemblies. The individual assemblies can be assembled in a large number of combinations. The main assemblies of the lifting device are fastened to the base frame, in particular the cable drum is mounted at that location. The base frame consists at least of two base plate disposed in parallel with, and spaced apart from, one another and are mutually connected via longitudinal supports. At least three screw connections for attaching the longitudinal supports thereto are provided for each face plate.

German patent application DE 196 02 927 A1 itself relates to a base frame for cable winches which is to be distinguished by reduced assembly outlay and lower weight. The base frame essentially consists of the two base plates which are mutually connected via an upper and a lower u-shaped longitudinal support and a tension element which, in parallel therewith, coincides with the axis of rotation of the cable drum. The tension element is made from solid material, threaded portions being provided at the opposing ends thereof, thus forming a shoulder. On one side, the tension element is screwed with its threaded portion into an internal thread provided centrally in a base plate and lies, with its annular shoulder over a disc, against the planar inner side of the base plate. A passage bore is provided centrally on the opposing base plate and is designed in a stepped manner in order to form an annular contact surface for receiving the shoulder of the pipe at the start of the threaded rod portion. The threaded rod portion is passed through the passage bore and tensioned against the outer side of the base plate from the outside by means of a threaded nut. In this connection the two u-shaped longitudinal supports are inserted into suitable blind hole-like recesses in the inner sides of the base plates and are held at that location between the base plates by the clamping force built up by the tension means.

In these prior art embodiments, the connecting elements between the base plates are designed as profiled parts with fully round or pipe cross-sections, the ends of which protrude into, or lie within, corresponding bores or correspondingly worked contact surfaces in the mutually facing surfaces of the base plates. Fastening is then effected via a screw connection which tensions the profiled parts against the base plates in the longitudinal direction of said profiled parts. These connection points between the profiled parts and the base plates can transmit both axial forces in the direction of the longitudinal axis of the connecting elements or of the cable drum as well as so-called corner moments. Corner moments are in this case understood to be moments which arise e.g. by the twisting of the base frame at the connection points between the base plates and connecting elements. At the same time, over the length of the profiled parts, the exact distance and the parallelism between the two base plates are achieved within the desired tolerances.

Furthermore, from German patent DE 10 2005 029 113 B3 a base frame for a lifting device is known which again has two parallel base plates spaced apart from one another. The base plates are spaced apart from one another and detachably connected to one another by longitudinal supports. For this purpose, the ends of the longitudinal supports enter blind bores in the mutually facing inner sides of the base plates and are pressed therein by screws against a contact surface in the blind bores and therefore transversely to the longitudinal direction of the longitudinal support.

US 2009/0308826 A1 discloses a base frame of a lifting device, the tubular longitudinal supports of which are tensioned with two base plates by means of pipe clip-like retaining elements. In this connection, the longitudinal supports are extended through retaining elements fastened in corner regions of the base plates and fixedly clamped via screws acting transversely to the longitudinal axis of the longitudinal support.

The components of the lifting device previously referred to as base plates can also be housing parts which fulfil different functions of the lifting device. For example, these serve for fastening the lifting drive, for mounting the cable drum, for attaching cross-pieces for parts of the cable reeving arrangement, for receiving the electrical equipment, for foot mounting of the lifting device or for attaching chassis components.

It results from this that the threaded nuts or screws for fastening the longitudinal supports to the base plates are often disposed in a poorly accessible way e.g. inside the housing. These connection points must also frequently be shifted out of the housing in order to provide accessibility. This makes assembly more difficult and the housings in the form of the base plates must be enlarged unnecessarily.

Furthermore, from DE 10 2010 026 651 A1 it is known to connect the base plates to one another via pipes. For this purpose, the pipe ends are held on the base plates by a press fit. Stoppers to create the press fit are pressed into the pipe ends.

Further base frames are known from U.S. Pat. No. 6,494,437 B1, US 2010/0288906 A1, FR 2 928 637 A1, US 2011/0079760 A1, EP 2 641 861 A1, US 2008/0061277 A1 and US 2014/0341696 A1.

EP 2 501 640 B1 discloses constructing the longitudinal supports for connection of the base plates of a lifting device through the base plates so that they are removable per se. For this purpose, the longitudinal supports are held in passage openings on one of the two base plates, for which reason the ends of all longitudinal supports are fixed to the base plate by means of a common planar retaining element. The retaining element is connected to the longitudinal support by means of a screw connection and is in turn itself fixed to the base plate. In this way, for maintenance, assembly, disassembly or conversion, it is possible to remove or pull out the longitudinal supports through the base plate on one side. For this purpose, the planar retaining element must be taken out completely. Alternatively, the retaining element can also be formed in two parts so that at least one part of the two-part retaining element always also forms a common retaining element for simultaneous fixing of at least two longitudinal supports.

SUMMARY OF THE INVENTION

The invention relates to the creation of an improved lifting device, in particular a cable winch, characterised by a constructionally simple structure and simple assembly, disassembly or conversion.

In accordance with an embodiment of the invention a lifting device, in particular a cable winch, having a base frame comprising at least two base plates, having at least two longitudinal supports comprising a first support end and an opposing second support end, said longitudinal supports connecting the base plates together and spacing them apart, wherein the first support end and the second support end of the longitudinal supports are detachably fastened to the base plates of the lifting device in such a way and one of the at least two base plates is designed in such a way that the longitudinal supports can be installed or removed in the direction of their longitudinal axis and through one of the at least two base plates, for which purpose passage openings for passage of the longitudinal supports are provided in one of the base plates of the at least two base plates, in each case one support end of the longitudinal supports is inserted and fastened in one of the passage openings and the support end of the longitudinal supports is fixed to the base plate via a retaining element in order to prevent displacement of the longitudinal support along the longitudinal axis in the direction of the two support ends, for which purpose the retaining element is fastened to an outer side of the base plate, is improved in such a way that for each longitudinal support a respective separate retaining element is provided.

In this way the advantage is achieved that a type of basic lifting device can be produced which can easily be adapted on site in relation to the arrangement and number of longitudinal supports between the two base plates. In this connection, the cable drum can remain between the two base plates. This advantage is also achieved in the case of conversion of the lifting device. The longitudinal supports and the base plates can also easily be produced mechanically. Furthermore, the basic lifting device can easily be attached to any connection construction without the basic lifting device have to be dismantled. The unit formed by base plates and the cable drum always remains connected via at least one longitudinal support. By means of the solution in accordance with the invention, a single longitudinal support can be taken out and can be removed individually through the passage opening without further ones or all of the remaining longitudinal supports or the retaining elements thereof having to be loosened. In other words, provision is no longer made for using a common retaining element for a plurality of or even for all of the longitudinal supports. After the associated retaining elements have been taken out, the longitudinal supports can also be displaced through the passage openings in at least one of the two opposing directions along the longitudinal axis in order to mount connection elements. In this way it is possible to dispense with complete removal of a longitudinal support when e.g. a chassis is to be mounted as a connection element. In the above-mentioned prior art solutions this is not possible or is possible only with considerably greater assembly outlay or, by the release of a common retaining element of a plurality of longitudinal supports, greater weakening of the stability of the base frame takes place than is possible by use in accordance with the invention of separate retaining elements.

In a preferred embodiment, the respective retaining element thus covers only one passage opening. For this purpose, the retaining element can comprise a first region for covering the passage opening.

In a constructionally simple manner, provision is advantageously made that the respective retaining element extends transversely to the longitudinal axis over less than a quarter of the outer side of the second base plate, in particular only in the corresponding corner region of the base plate. This permits simple construction of the retaining elements.

Each retaining element can thus be fixed to the base plate via a fastening element, in particular a screw. For this purpose, the retaining element can comprise a second region for fixing to the base plate.

In a preferred manner, the retaining element is a flat, planar component, in particular a flat steel plate. This can be in the shape of an arc of a circle in the first region and be trapezium-like in the second region so that a shape merged from a circle segment and a partial trapezium is produced.

Form-locking reception of the longitudinal supports in the base plate is achieved in that the passage openings each have a cross-sectional surface which are slightly larger than the cross-sectional surface of the longitudinal supports.

The stability of the base frame in the longitudinal direction is achieved in that, when the lifting device is in the operating state, a respective support end of the longitudinal supports extends and is fastened in one of the passage openings. As a type of attachment, provision is advantageously made that, when the lifting device is in the operating state, the support end of the longitudinal supports is fixed to the base plate via a retaining element in and opposite to the direction of the longitudinal axis of the longitudinal support.

In a preferred embodiment, provision is made that the support end of the longitudinal supports comprises a retaining bore and the support end is fixed to the retaining element via a fastening element, in particular a screw, which engages in the retaining bore.

According to this method, all support ends can be fastened to the base plates.

At one of the two opposing support ends, provision can alternatively be made that blind openings are provided in the corresponding base plate of the at least two base plates on the inner side thereof, into which openings, when the lifting device is in the operating state, a respective one of the support ends of the longitudinal supports is inserted and is fastened supporting itself against the base plate. In this case, blind openings can be provided since the longitudinal supports are removed at the opposing end or installed from that location.

As a constructional detail the corresponding support end of the longitudinal supports is fastened in the blind opening via a screw which is oriented in the direction of the longitudinal axis of the longitudinal support and is supported on the outer side of the associated base plate.

Assembly, disassembly and conversion are achieved in that the screws are each accessible for releasing and fastening purposes from an outer side of the corresponding base plate.

Provision is advantageously made that the base plates are rectangular, a respective blind opening or a passage opening being provided in the corners of a notional quadrilateral in the base plates.

The longitudinal supports are preferably designed as rods with a round cross-section and consequently the passage openings or the blind openings have a round cross-section.

In a conventional manner provision is made that a cable drum is mounted at both ends between and on the inner sides of the base plates, the axis of rotation of which cable drum is oriented in parallel with the longitudinal axis of the longitudinal supports.

An exemplified embodiment of the invention will be explained in greater detail hereinafter with reference to the drawings.

DESCRIPTION OF THE PREFERRED EMBODIMENTS

Figure 1:
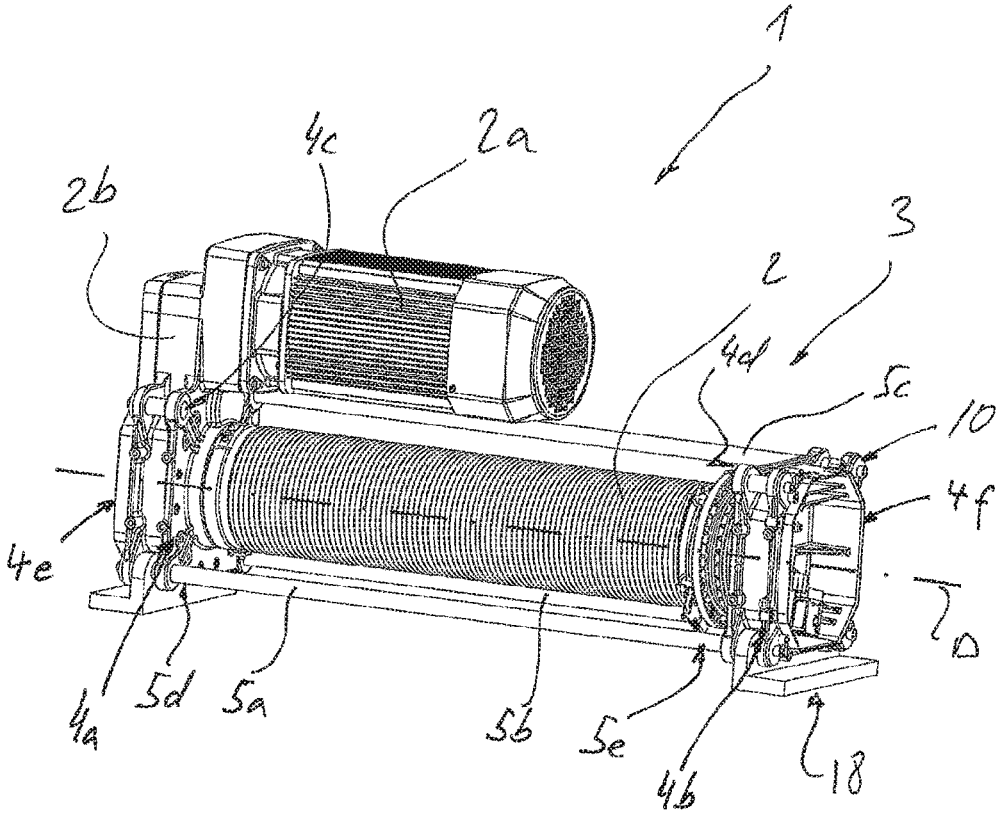
FIG. 1 shows a perspective view of a lifting device in accordance with the invention.

FIG. 1 shows a perspective view of a lifting device in accordance with the invention in the form of a cable winch 1 of a lifting apparatus with a cable drum 2 which is mounted at both ends in a base frame 3.

The base frame 3 has a shape with an overall cuboidal notional envelope and comprises a first base plate 4*a* and a second base plate 4*b*, on the mutually facing first and second inner sides 4*c* and 4*d* of which the cable drum 2 is mounted. The cable drum 2 is able to rotate about an axis of rotation D and is driven by an electric motor 2*a* via a transmission 2*b*. The first base plate 4*a* and the second base plate 4*b* are each cuboidal or rectangular.

Furthermore, the base frame 3 comprises a plurality of, in particular four, longitudinal supports, of which FIG. 1 shows a first longitudinal support 5*a*, a second longitudinal support 5*b* and a third longitudinal support 5*c*. The base plates 4*a*, 4*b* are spaced apart from one another and connected to one another via the longitudinal supports 5*a*, 5*b*, 5*c*. In this connection, the longitudinal supports 5*a*, 5*b*, 5*c* each extend between the opposing corners, serving as fastening locations, of a notional quadrilateral, in particular a rectangle, preferably a square, provided on the first and second base plates 4*a*, 4*b*. In the case of the second base plate 4*b*, the longitudinal supports 5*a*, 5*b*, 5*c* are disposed in the corner regions of the virtually square base plate 4*b*. Compared with the second base plate 4*b* the first base plate 4*a* has a rectangular shape since this is lengthened beyond the third longitudinal support 5*c* and the possible fourth longitudinal support, not shown, in order to fasten the electric motor 2*a*. In a corresponding manner, the first and second longitudinal supports 5*a*, 5*b* are disposed in the region of the lower corner regions of the first base plate 4*a* and the third longitudinal support 5*c* and a possible fourth longitudinal support are disposed in the region of the middle and of the side edge of the first base plate 4*a*. Furthermore, this first base plate 4*a*, in the region of its outer side 4*e*, receives the transmission 2*b* which drivingly connects the cable drum 2 to the electric motor 2*a*.

The longitudinal supports 5*a*, 5*b* are designed as rods of solid material and, depending on the use of the cable winch 1, at least two and up to four longitudinal supports 5*a*, 5*b*, 5*c* are provided which are disposed in selected or in all opposing corners of the notional quadrilateral on the base plates 4*a*, 4*b*. The longitudinal supports 5*a*, 5*b*, 5*c* are intended to connect the base plates 4*a*, 4*b* to one another in a twisting-resistant manner and, over the length of the longitudinal supports 5*a*, 5*b*, 5*c* the desired spacing and parallelism between the two base plates 4*a*, 4*b* is achieved within the desired tolerances. In the illustrated exemplified embodiment, a total of three longitudinal supports 5*a*, 5*b*, 5*c* are provided. In order not to hinder the winding and unwinding of a cable, not shown, by the cable drum 2 a fourth longitudinal support is not mounted in this case. According to requirements, usage or the installation situation, the three longitudinal supports 5*a*, 5*b*, 5*c* or even four can be fastened to desired fastening locations or corners of the notional quadrilaterals.

The longitudinal supports 5*a*, 5*b*, 5*c* each have a first support end 5*d* and an opposing second support end 5*e*. The first support ends 5*d* are each fastened in the first base plate 4*a* and the second support ends 5*e* are each fastened in the second base plate 4*b*. The special manner of fastening the second support ends 5*e* in the second base plate 4*b* is explained in conjunction with FIGS. 3 and 4.

FIG. 1 shows the cable winch in a so-called operating state, i.e. after complete mounting of the longitudinal supports 5*a*, 5*b*, 5*c*. In this operating state, the longitudinal supports 5*a*, 5*b*, 5*c* are oriented with their longitudinal axes L in parallel with and laterally offset with respect to the axis of rotation D of the cable drum 2.

FIG. 1 shows a cable winch 1 with a base frame 3 in accordance with the invention. A cable winch 1 of this type can, as a basic lifting device, be a component of a modular design system and be used in a different manner by reason of connection elements 18. As a so-called foot-mounted hoist—as shown in FIG. 1—this can be fastened to a stationary component. For this purpose, corresponding connection elements 18 are fastened to the base plates 4*a*, 4*b*. This cable winch 1 can also be a component of a crane trolley in which chassis components are fastened to the base plates 4*a*, 4*b*. A lower flange crane trolley, a single-rail crane trolley with the cable winch 1 arranged next to the rail and a dual-rail crane trolley are possible crane trolley constructions.

In a corresponding manner, the base plates 4*a*, 4*b* have, in addition to the mounting of the cable drum 2, different further functions such as e.g. supporting the electric drive 2*a*, receiving attachment cross-pieces for parts of a cable reeving arrangement, housing electric equipment, permitting foot mounting of the cable winch or attaching chassis components.

Figure 2:
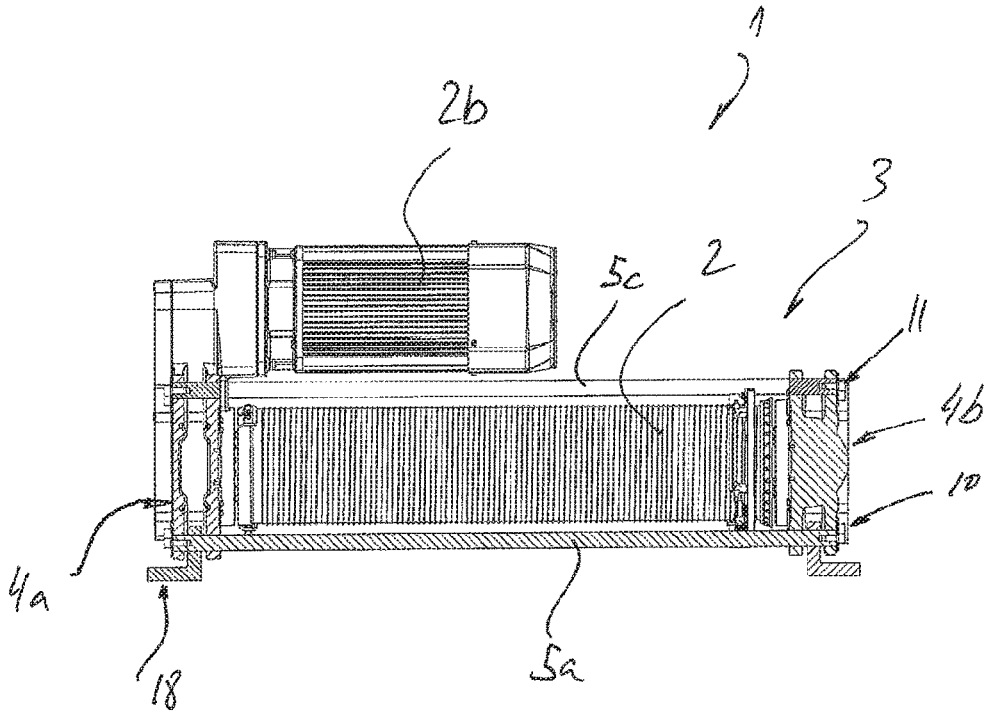
FIG. 2 shows a side view of FIG. 1—partly in cross-section.

FIG. 2 shows a partially cut-away side view of the cable winch 1 according to FIG. 1. It can be seen that the two base plates 4*a*, 4*b* are produced as cast parts. The implementation of the connection between the support ends 5*d*, 5*e* and the base plates 4*a*, 4*b* is now explained in more detail with the aid of FIGS. 2, 3 and 4.

Figure 3:
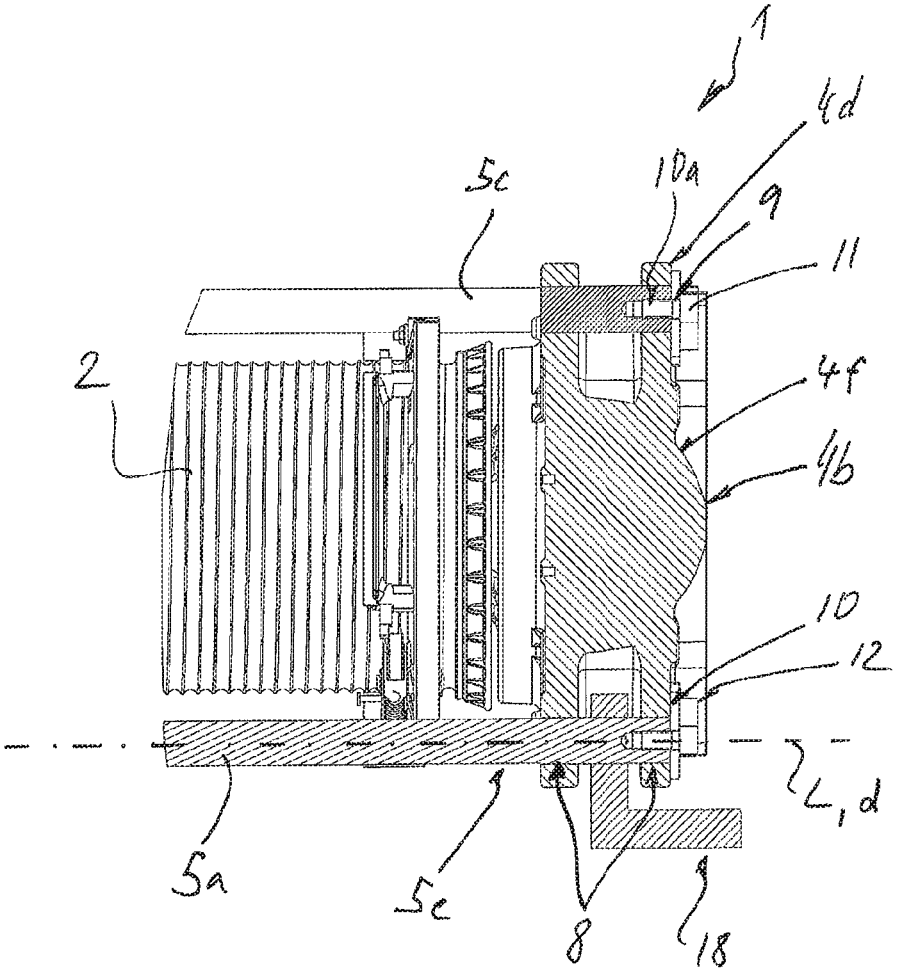
FIG. 3 shows a detail of FIG. 2 from the region of fastening a longitudinal support to a first base plate of the base frame and FIG. 4 shows a perspective view of FIG. 3.
Figure 4:
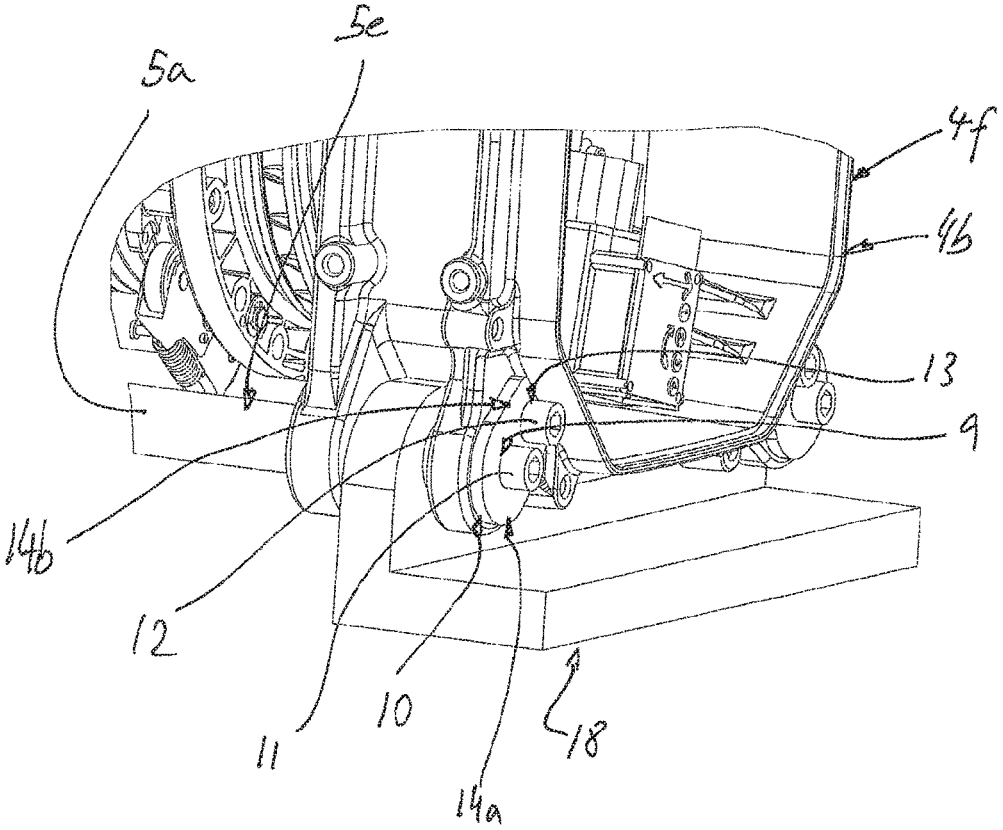

FIG. 3 shows an enlargement of a section of FIG. 2 from the region of the second base plate 4*b*. As previously described in relation to FIG. 1, the second base plate 4*b* has the same fastening options for a total of up to four longitudinal supports 5*a*, 5*b*, 5*c* or less than four longitudinal supports 5*a*, 5*b*, 5*c* at four different fastening locations. FIG. 3 shows by way of example the fastening locations for the first and third longitudinal supports 5*a*, 5*c*. In order to fasten the longitudinal supports 5*a*, 5*c* with their second support ends 5*e* to the second base plate 4*b* a respective passage opening 8 is provided in the second base plate 4*b* in the region of the desired fastening locations. In the present exemplified embodiment, the passage opening 8 is formed, as seen in the longitudinal direction of the longitudinal axis L, in two parts with a front and a rear part—separated by an intermediate space—in order to create a type of multiple-shear bolt connection. By means thereof, connection elements 18 can then easily be fastened to the base plates 4*a*, 4*b*. A single-piece design for the passage opening 8 is also possible. The first base plate 4*a* can in the same way comprise corresponding passage openings 8.

Since the longitudinal supports 5*a*, 5*b*, 5*c* are designed as rods with a round cross-section, the passage openings 8 each have a cross-sectional surface which is slightly larger in particular in relation to their diameter than the cross-sectional surface of the longitudinal supports 5*a*, 5*b*, 5*c* which is disposed concentrically in the operating state. The longitudinal supports 5*a*, 5*b*, 5*c* therefore have form-locking contact with the second base plate 4*b*. The central passage axis d of the passage opening 8 therefore coincides with the longitudinal axis L of the longitudinal supports 5*a*, 5*b*, 5*c* in the operating state.

In order to secure the second support end 5*e* of the longitudinal supports 5*a*, 5*b*, 5*c* against displacement in the two opposing directions along the longitudinal axis L of the longitudinal supports 5*a*, 5*b*, 5*c*, a holding bore 10*a* which has an internal thread and extends centrally in the direction of the first support end 5*d* along the longitudinal axis L of the longitudinal supports 5*a*, 5*b*, 5*c* is provided in the second support end 5*e* starting from the outer end face.

At the same time, for each longitudinal support 5*a*, 5*b*, 5*c* a respective separate retaining element 10 is provided which has a bore 9 through which a screw 11 passes and engages in the retaining bore 10*a* so that the second support end 5*e* is fixed to the retaining element 10.

The respective retaining element 10 thus covers only a single passage opening 8 and is fixed to the outer side 4*f* of the base plate 4*b* by means of a further screw 12 which passes through a corresponding further bore 13. In this way, the corresponding longitudinal support 5*a*, 5*b*, 5*c* is fixedly held on the base plate 4*b* and secured against movement along the longitudinal axis L in the direction of one of the support ends 5*d*, 5*e*.

The retaining element 10 is a flat planar steel component. The retaining element 10 has a first region 14*a* for covering the passage opening 8 provided with the bore 9 and has a second region 14*b* for fixing to the base plate 4*b* which is provided with a further bore 13. In the first region 14*a*, the retaining element is in the form of an arc of a circle and in the second region 14*b* it is trapezium-like or trapezoidal so that a shape merged from a circle segment and a partial trapezium is produced which approximately corresponds to a type of droplet shape (cf. FIG. 4). In this connection, as seen in the direction of the longitudinal axis L, the retaining element 10 extends with both regions 14*a*, 14*b* in a direction transverse to the longitudinal axis L only slightly beyond the associated passage opening 8 along the outer side 4*f* of the second base plate 4*b*. Each retaining element 10 preferably extends only over clearly less than a quarter of the outer side 4*f* of the second base plate 4*b*, in particular only in the corresponding corner region of the base plate 4*b*. Therefore, none of the retaining elements 10 can serve as a common retaining element 10 for more than one of the longitudinal supports 5*a*, 5*b*, 5*c* since it does not extend over or cover two passage openings 8 at the same time. It is rather the case that for each longitudinal support 5*a*, 5*b*, 5*c* a separate dedicated retaining element 10 must be used.

By this type of fastening of the second support ends 5*e* in the passage openings 8 by means of respective one of the retaining elements 10 with the screw 11 and the screw 12 it is possible, after the retaining element 10 has been taken out, to displace the respectively associated longitudinal support 5*a*, 5*b*, 5*c* individually and independently of the remaining still fastened longitudinal supports 5*a*, 5*b*, 5*c* along the longitudinal axis L through the passage opening 8 out of the second base plate 4*b* or to pull it out completely. Therefore, it is possible, without taking out the cable drum 2, to change the position or number of the longitudinal supports 5*a*, 5*b*, 5*c*.

It will be understood that the first support ends 5*d* of the longitudinal supports 5*a*, 5*b*, 5*c* can also be fastened to the first base plate 4*a* in each case in the same manner as the second support ends 5*e* are fastened to the second base plate 4*b* by means of a separate retaining element 10. Therefore, after the associated retaining elements 10 have been taken out, the longitudinal supports 5*a*, 5*b*, 5*c* can each at least be displaced and also removed through the passage openings 8 individually along the longitudinal axis L selectively in one of the two opposing directions, i.e. in the direction of one of the two support ends 5*d*, 5*e*.

LIST OF REFERENCE SIGNS

1 cable winch
2 cable drum
2*a* electric motor
2*b* transmission
3 base frame
4*a* first base plate
4*b* second base plate
4*c* inner side of the first base plate 4*a*
4*d* inner side of the second base plate 4*b*

4*e* outer side of the first base plate 4*a*
4*f* outer side of the second base plate 4*b*
5*a* first longitudinal support
5*b* second longitudinal support
5*c* third longitudinal support
5*d* first support end
5*e* second support end
8 passage opening
9 bore
10 retaining element
10*a* retaining bore
11 screw
12 screw
13 bore
14*a* first region
14*b* second region
18 connection element
d passage axis
D axis of rotation
L longitudinal axis

The invention claimed is:

1. A lifting device, said lifting device having a base frame comprising at least two base plates, having at least two longitudinal supports comprising a first support end and an opposing second support end, said longitudinal supports connecting the base plates together and spacing them apart, wherein the first support end and the second support end of the longitudinal supports are detachably fastened to the base plates of the lifting device in such a way and one of the at least two base plates is designed in such a way that the longitudinal supports can be installed or removed in the direction of their longitudinal axis and through one of the at least two base plates, for which purpose passage openings for passage of the longitudinal supports are provided in one of the base plates of the at least two base plates, in each case one support end of the longitudinal supports is inserted and fastened in one of the passage openings and the support end of the longitudinal supports is fixed to the base plate via a retaining element in order to prevent displacement of the longitudinal support along the longitudinal axis in the direction of the two support ends, for which purpose the retaining element is fastened to an outer side of the base plate, wherein the support end of the longitudinal supports has a retaining bore, and the retaining element is fixed to the support end via a first fastening element that engages in the retaining bore, wherein for each longitudinal support a respective separate retaining element is provided, and that, in addition to the first fastening element, a second fastening element is provided by means of which the respective retaining element is fixed to the base plate.

2. The lifting device as claimed in claim 1, wherein the respective retaining element covers only one passage opening.

3. The lifting device as claimed in claim 2, wherein the respective retaining element extends transversely to the longitudinal axis over less than a quarter of the outer side of the base plate in the corresponding corner region of the base plate.

4. The lifting device as claimed in claim 3, wherein the retaining element is a flat planar component.

5. The lifting device as claimed in claim 4, wherein the retaining element has a first region for covering a passage opening.

6. The lifting device as claimed in claim 5, wherein the retaining element for fixing to the base plate.

7. The lifting device as claimed in claim 2, wherein the retaining element is a flat planar component.

8. The lifting device as claimed in claim 2, wherein the retaining element has a first region for covering a passage opening.

9. The lifting device as claimed in claim 8, wherein the retaining element has a second region for fixing to the base plate.

10. The lifting device as claimed in claim 2, wherein the retaining element has a second region for fixing to the base plate.

11. The lifting device as claimed in claim 1, wherein the respective retaining element extends transversely to the longitudinal axis over less than a quarter of the outer side of the base plate in the corresponding corner region of the base plate.

12. The lifting device as claimed in claim 11, wherein the retaining element is a flat planar component.

13. The lifting device as claimed in claim 11, wherein the retaining element has a first region for covering a passage opening.

14. The lifting device as claimed in claim 11, wherein the retaining element has a second region for fixing to the base plate.

15. The lifting device as claimed in claim 1, wherein the retaining element is a flat planar component.

16. The lifting device as claimed in claim 15, wherein the retaining element has a first region for covering a passage opening.

17. The lifting device as claimed in claim 15, wherein the retaining element has a second region for fixing to the base plate.

18. The lifting device as claimed in claim 1, wherein the retaining element has a first region for covering a passage opening.

19. The lifting device as claimed in claim 18, wherein the retaining element has a second region for fixing to the base plate.

20. The lifting device as claimed in claim 1, wherein the retaining element has a second region for fixing to the base plate.

* * * * *